United States Patent [19]

Natter

[11] Patent Number: 4,890,581

[45] Date of Patent: Jan. 2, 1990

[54] METHOD AND PLANT FOR PURIFYING THE EXHAUST AIR FROM A TENTERFRAME OR A SINGER

[75] Inventor: Arthur Natter, Wolfurt, Austria

[73] Assignee: Peter Koenig, Arbon, Switzerland

[21] Appl. No.: 276,000

[22] Filed: Nov. 25, 1988

[30] Foreign Application Priority Data

Dec. 1, 1987 [CH] Switzerland ..... 4689/87

[51] Int. Cl.[4] ..... F22B 33/00

[52] U.S. Cl. ..... 122/1 A; 110/210; 110/214; 422/182; 431/5

[58] Field of Search ..... 431/5, 202; 422/173, 422/182; 110/210, 211, 214; 122/1 R, 1 A, 1 C

[56] References Cited

U.S. PATENT DOCUMENTS

| | | | |
|---|---|---|---|
| 3,909,953 | 10/1975 | Hemsath et al. | 34/26 |
| 4,176,162 | 11/1979 | Stern | 431/5 X |
| 4,331,167 | 7/1982 | St. John | 110/210 X |
| 4,489,679 | 12/1984 | Holt | 122/451 S |
| 4,820,500 | 4/1989 | Obermuller | 431/5 X |

FOREIGN PATENT DOCUMENTS

| | | |
|---|---|---|
| 3145028 | 5/1983 | Fed. Rep. of Germany . |
| 145527 | 5/1931 | Sweden . |

*Primary Examiner*—Edward G. Favors

*Attorney, Agent, or Firm*—Sughrue, Mion, Zinn, Macpeak and Seas

[57] ABSTRACT

The exhaust air from the tenterframe (1) conveyed by a fan (7) is fed as combustion air to the burner (13) of a steam boiler (21). The burner (13) is operated with a variable and high excess of air of $\lambda=1,5$ to $\lambda=3,5$. The boiler output is regulated by the fuel supply. The excess of air is increased at low boiler load. The boiler exhaust gas is cooled down below the dew point via three heat exchangers (29,30,31). Thus complete combustion of the organic noxious substances in the tenterframe exhaust air and at the same time recovery, which can be readily utilized, of the tenterframe waste heat and a lowering of the fuel requirement of the steam boiler are achieved. The same method is also suitable for purifying the exhaust air from singers.

10 Claims, 3 Drawing Sheets

METHOD AND PLANT FOR PURIFYING THE EXHAUST AIR FROM A TENTERFRAME OR A SINGER

BACKGROUND ART

In textile finishing, webs of material, e.g. for thermofixing in tenterframes, are heated to about 180°. The exhaust air from such tenterframes is drawn off by means of a fan and is normally conducted into the open air via a flue. This exhaust air is considerably polluted with hydrocarbons, inter alia paraffins, and smells nasty. In addition, on account of its high temperature of about 140° C., it contains considerable quantities of energy. Attempts to recover this energy in a heat exchanger have hitherto failed, since these heat exchangers become dirty very quickly and can hardly be cleaned.

To remove noxious substances in exhaust air, it is proposed in the VDI guidelines 2442 of June 1987 to heat the exhaust air in an exhaust-reheat plant by means of a burner to about 750° to 900° C. and then to cool it down again with a heat exchanger. In the process, the exhaust air to be purified is heated in the heat exchanger in the counterflow so that the fuel costs can be kept as low as possible. Such plants are exceptionally expensive and, apart from a reduction in environmental pollution do not produce any useful effect. The waste heat still contained in the gas can seldom be reasonably utilized economically. In addition, the gas-gas heat exchanger operating at high temperature poses considerable material problems so that a temperature of over 800° C. desired per se often cannot be run.

In Melliand textile reports 8/1985, pages 603 to 604, it is proposed by Peter ter Duis to supply as combustion air to a steam boiler a portion of the exhaust air from a tenterframe. In this arrangement, the intake line of the burner is connected to the exhaust-air flue of the tenterframe. In the plant described, all the exhaust air from the tenterframe can be purified in certain cases at full load of the steam boiler. At the same time, the efficiency of the furnace can be improved, since it is supplied with hot combustion air. At full load of the boiler, additional fresh air is drawn in via the flue; at reduced load, on the other hand, the excess portion of the tenterframe exhaust air escapes into the open air via the flue. A considerable disadvantage of this plant is therefore that, during partial-load operation of the boiler, only a fraction of the tenterframe exhaust air can be purified and environmentalpollution thus continues to a considerable extent.

There are similar problems in the operation of a singer, wherein the problems of smell are here aggravated but the exhaust air is less moist and therefore has less heat content. The exhaust air from a singer contains more proportions of solid matter than that from a tenterframe.

SUMMARY OF THE INVENTION

The object of the invention is to create a method and a plant for purifying the exhaust air from a tenterframe or a singer with which the exhaust air can be purified as completely as possible and its heat content can be recovered. According to one aspect of the present invention there is provided a method for purifying the exhaust air from a tenterframe or a singer by thermal combustion, the exhaust air being supplied as combustion air to a heat-supply device. In its partial-load operation the heat-supply device is operated with a large excess of air of $\lambda=1,5$ to $\lambda=3,5$.

According to another aspect of the present invention, there is provided a plant for purifying the exhaust air from a tenterframe or a singer, comprising a tenterframe or a singer, having an exhaust-air fan, and a heatsupply device which has a burner, the exhaust-air fan being connected to the burner via a thermally insulated line. The burner is designed for operating with a large excess of air of $\lambda=1,5$ to $\lambda=3,5$.

Conventional heat-supply devices (e.g. steam, heating, thermal-oil boilers, etc.) are always operated with an excess of air which is as small as possible and is constant over the entire performance range, since a higher excess of air reduces the efficiency and leads to losses. The air not involved in the combustion must after all be heated from the intake temperature to the exhaust-gas temperature. In the method according to the invention, this generally applicable principle is broken. Surprisingly, the large excess of air, in the method according to the invention, results in no reduction or only an insignificant reduction in efficiency during the partial-load operation of the heat-supply device, even if the waste heat is not utilized. This is because it has turned out that the combustion of the noxious substances carried in the exhaust air from the tenterframe during the fixing operation is sufficient to heat this air by about 50° to 100° C. In the method according to the invention, in contrast to all known heat-supply devices, the heat supply device can be operated with a large excess of air without loss in efficiency. Therefore in the plant according to the invention, in contrast to the above-described plant according to ter Duis, all the exhaust air from the tenterframe or the singer can be purified even during the partial-load operation of the heat-supply device.

Since in the method according to the invention the organic noxious substances in the exhaust air are completely burnt, it is possible to cool down the exhaust gas considerably and thus recover the sensible heat of the tenterframe exhaust air. An especially large recovery of energy is possible when natural gas is used as the fuel in the burner and the exhaust gas is cooled down below the dew point. In that case not only is the gross calorific value of the fuel and the noxious substances in the exhaust air utilized, but the latent waste heat of the tenterframe exhaust air is also largely recovered. Since the tenterframe exhaust air usually has a high water-vapour content, considerable energy can thus be recovered. In a steam boiler, the heat recovered can be utilized very efficiently to preheat the feed water. In this mode of operation, an increase in the excess of air leads to an increase in efficiency and a reduction in the fuel requirement.

Textile finishing plants with tenterframes or singers usually have steam boilers of adequate size in order to purify all the exhaust air from the tenterframe or the singer in the manner according to the invention. In these plants, only a thermally insulated exhaust-air line between the tenterframe and the boiler and a change to the boiler control, and if need be the burner, are necessary. Therefore, in addition to complete purification of the exhaust air, recovery of the waste heat and a substantial reduction in the fuel costs can be achieved with low investment costs. In the process, combustion temperatures above 1000° C. are achieved, even at a very high excess of air of, for example, $\lambda=3$, so that reliable combustion of all noxious substances is achieved.

In addition, in the method according to the invention, the high excess of air results in a marked reduction in the $NO_x$-content in the exhaust gas.

DESCRIPTION OF PREFERRED EMBODIMENTS

Figure 1:
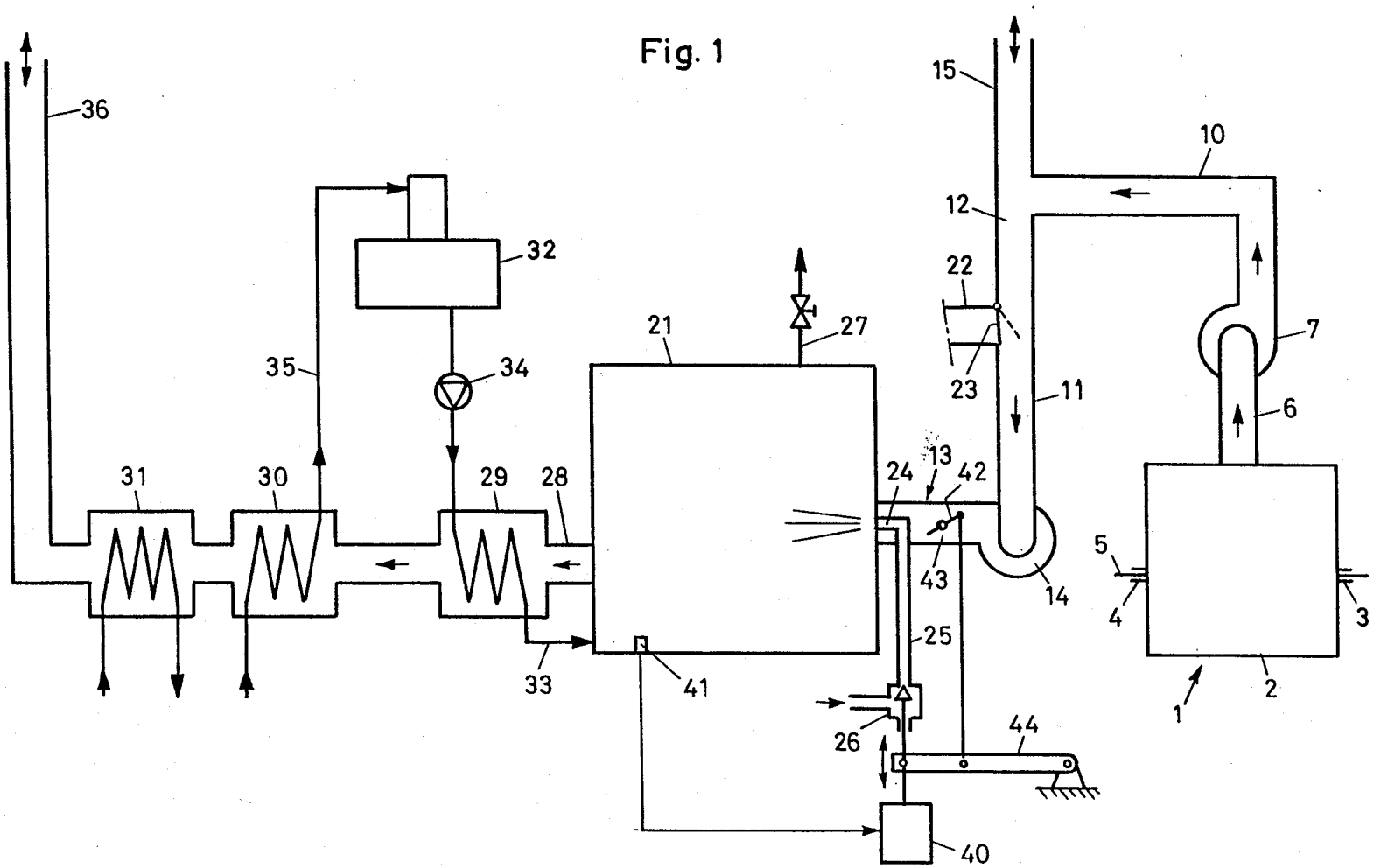
FIG. 1 shows a diagram of a first embodiment.

A tenterframe 1 has a totally enclosed housing 2 having an inlet slot 3 and an outlet slot 4 for a web 5 of material. The interior of the housing 2 is connected to a suction fan 7 via an exhaust-air line 6. The fan 7 conveys the exhaust air into a thermally insulated connecting line 10. The insulation of the line 10 serves to avoid on the one hand heat losses and on the other hand condensation of water and noxious substances from the exhaust air. The connecting line 10 is connected to the combustion air supply opening 12 of a burner 13 of a steam boiler 21. A further thermally insulated line 11 extends between the opening 12 and the burner 13. The combustion air is supplied to the burner 13 via a burner fan 14. A compensating flue 15 branches off from the line 10 at the supply opening 12. So that the boiler 21 can also operate independently of the tenterframe 1, a fresh-air intake connection 22 branches off from the line 11. Controlled by a flap valve 23, the combustion air is drawn either from the line 10 or the connection 22. The burner 13 has a fuel nozzle 24 with a fuel feed line 25. A fuel valve 26 for regulating the fuel flow is arranged in the feed line 25. A steam line 27 and also an exhaust-gas line 28 are connected to the steam boiler 21. Three heat exchangers 29, 30, 31 are arranged in the exhaust-gas line 28, the first heat exchanger 29 cooling the exhaust gas and thus preheating the boiler feed water delivered from a feed-water tank 32 by means of a pump 34. The preheated feed water is supplied to the boiler 21 via a feed line 33. The tank 32 is fed with fresh water via a line 35. The fresh water is preheated by the second heat exchanger 30. The heat exchanger 31 serves to heat process or heating water. Finally, the cooled exhaust gas escapes via a flue 36.

The fuel valve 26 is regulated by a controller 40. As a control value, the steam pressure of the boiler 21, for example, is fed as a signal into the controller, which steam pressure is measured by a sensor 41. As the steam pressure drops, the valve 26 opens proportionally. At the same time, a flap valve 42 in the combustion-air supply duct 43 of the burner 13 is regulated by the controller 40. In contrast to conventional burner control systems, the flap valve 4, in the method according to the invention, is now controlled in such a way that the excess of air increases as the boiler load decreases. If the burner 13 e.g. at full load, is set for an excess of air of $\lambda=1,2$, the control of the flap valve 42 can be designed in such a way that the excess of air increases to $\lambda=2,2$ at $\frac{1}{3}$ load of the boiler 21. This change compared with conventional burner control systems is shown symbolically in FIG. 1 by a reduction lever 44 between the output of the controller 40 and the flap valve 42.

In most cases, despite fluctuating boiler load, this measure enables all the exhaust air from the tenterframe 1 to be supplied as combustion air to the burner.

Natural gas is conveniently used as the fuel. In this case, the exhaust gas can be cooled down below the dew point in the heat exchangers 29, 30, 31 and thus both the sensible and latent waste heat of the tenterframe exhaust air can largely be recovered. In addition, the gross calorific value of the fuel and noxious substances in the exhaust air is thus utilized. Due to the high excess of air, a reduction in the fuel requirement of up to about 20 % is thus achieved.

If heating oil is used as the fuel, the heat exchangers 30 and 31 are conveniently omitted.

Figure 2:
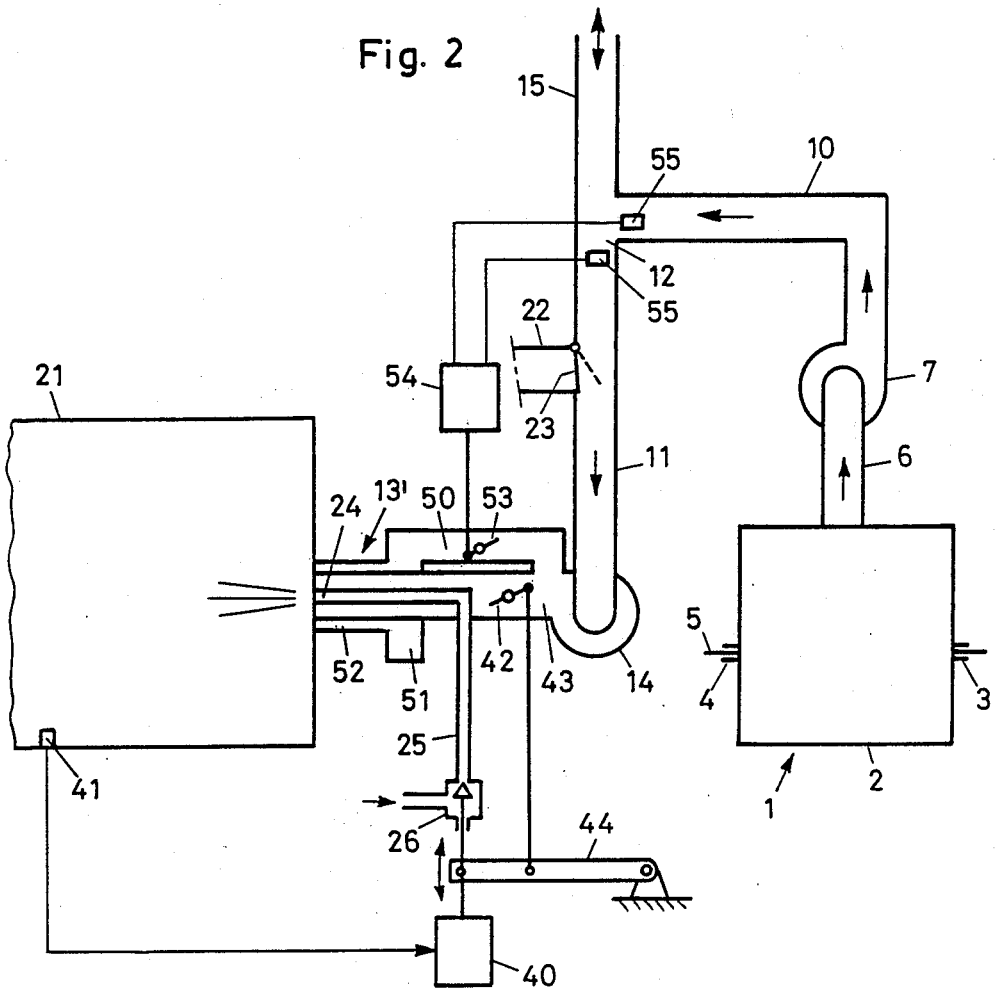
FIG. 2 shows a diagram of a second embodiment.

A further embodiment of the invention is shown in FIG. 2. The same parts have the same reference numerals so that a detailed explanation of these parts is unnecessary. In the duct 43, as in the exemplary embodiment described above, primary and secondary air, controlled by the flap valve 42, is supplied as a function of the boiler load to the burner 13', the excess of air again increasing as boiler load decreases. Upstream of the flap valve 42, a further duct 50 branches off from the duct 43. This duct 50 opens out into an annular space 51 around the duct 43. An annular duct 52 leads from the annular space 51 to the burner head in the boiler 21. Tertiary air can be supplied to the burner head via this annular duct 52. A flap valve 53 is arranged in the duct 50 to control the supply of tertiary air. The flap valve 53 is controlled by a further controller 54. The controller 54 receives as a control value the difference between the exhaust-air temperature upstream and downstream of the compensating flue 15. For this purpose, a temperature sensor 55 is arranged in each of the lines 10, 11. The temperature difference is set, for example, to 5° C. so that a small quantity of fresh air always flows in through the flue 15. If the temperature difference increases, the controller 54 reacts and proportionally closes the flap valve 53. When the temperature difference decreases, the flap valve 53 is opened.

As a result of this design, the excess of air can be additionally increased so that all the tenterframe exhaust air can be purified even when the boiler load varies greatly. In addition, fluctuations in the exhaust air quantity arising are automatically compensated.

Figure 3:
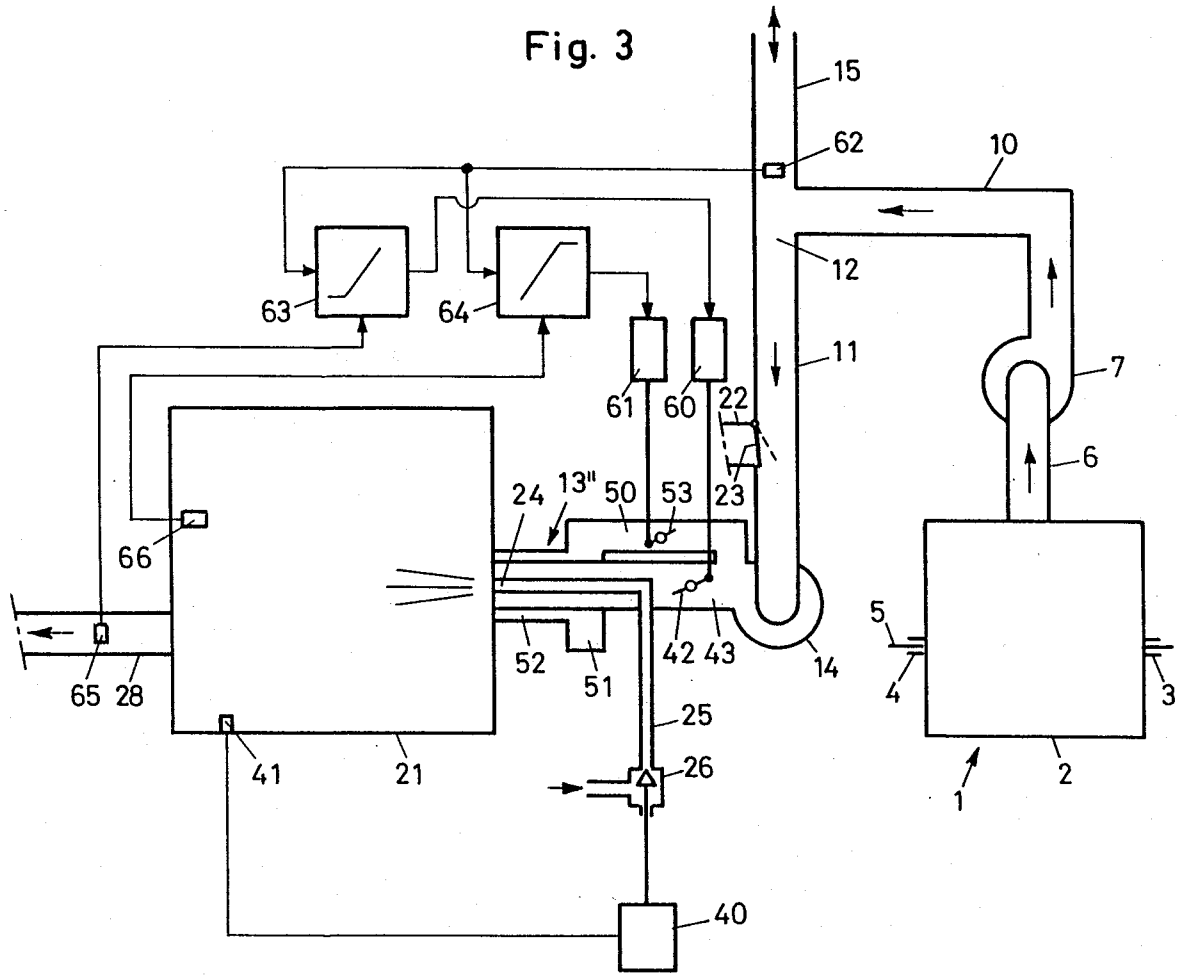
FIG. 3 shows a diagram of a third embodiment.

A third embodiment of the invention is shown in FIG. 3, the same reference numerals again being used for the same parts. Here, the burner 13" again has a tertiary-air duct 50, 51, 52. The flap valve 42 for primary and secondary air is uncoupled from the fuel control valve 26 and is controlled by a servomotor 60. A second servomotor ⊕controls the tertiary-air flap valve 53. The two servomotors 61 are controlled by a temperature sensor 62 in the compensating flue 15. This control system works analogously to that having the two temperature sensors 55 in FIG. 2: the desired value for the temperature of the sensor 62 is set, for example, about 10° C. above the outside temperature. This ensures that a small quantity of fresh air constantly enters through the flue 15 and no tenterframe exhaust air escapes. The signal from the sensor 62 is sent to the two servomotors 60, 61 via two controllers 63, 64. The first controller 63 has a variable lower limit for the output signal. This lower limit is set as a function of the signal from an $O_2$-sensor 65 in the exhaust-gas line 28. This ensures that, at full load of the boiler and at a low exhaust air quantity from the tenterframe, the excess of air does not fall below a certain minimum value of, for example, $\lambda=1,2$. This lower limit only acts on the flap valve Δfor primary and secondary air. For the flap valve 53 for teriary air, a variable upper limit of the opening cross-section is provided in the controller 64. The upper limit is fed into the controller 64 by a temperature sensor Δat the end of the fire tube of the boiler 21.

At this point, the temperature is not to fall below 800° C. so that reliable combustion of all the noxious substances is ensured and the emission of CO is avoided. This lower limit temperature corresponds to an excess of air of about $\lambda=3,5$.

As a result of this design, optimum efficiency over the entire load range of the boiler 21 is achieved with minimum intake of fresh air.

I claim:

1. A method for purifying the exhaust air from a tenterframe (1) or a singer by thermal combustion, the exhaust air being supplied as combustion air to a heat-supply device (21), wherein the heat-supply device (21), in its partial-load operation, is operated with a large excess of air of $\lambda=1,5$ to $\lambda=3,5$.

2. The method according to claim 1, wherein the excess of air is varied as a function of the load of the heatsupply device (21), the excess of air being reduced as load increases.

3. The method according to claim 1, wherein the excess of air is varied as a function of the exhaust-air quantity arising, the excess of air being increased as exhaust-air quantity increases.

4. The method according to claim 3, wherein the excess of air is regulated and has an upper and a lower limit.

5. The method according to claim 1, wherein natural gas is used as a fuel, and wherein the exhaust gas from the heat-supply device (21) is cooled down to a temperature below its dew point.

6. A plant for purifying the exhaust air from a tenterframe (1) or a singer, comprising a tenterframe (1) or a singer having an exhaust-air fan (7), and a heat-supply device (21) which has a burner (13), the exhaust-air fan (7) being connected to the burner (13) via a thermally insulated line (10), wherein the burner (13) is designed for operating with a large excess of air of $\lambda=1,5$ to $\lambda=3,5$.

7. The plant according to claim 6, wherein the fuel supply and the air supply to the burner (13) of the heat-supply device (21) are regulated by a controller (40), wherein the controller (40) is set in such a way that the excess of air drops as load of the heat-supply device increases.

8. The plant according to claim 6, wherein the fuel supply and the air supply to the burner (13) are regulated by one controller (40,54;40,63,64) each, wherein a sensor (55,62) for measuring the exhaust-air quantity arising is arranged in the connecting line (10,11), and wherein the sensor (55,62) is connected to the controller (54;63,64) for the air supply to the burner (13',13'') in such a way that the excess of air increases as the exhaust-air quantity increases.

9. The plant according to claim 8, wherein a second sensor (65) for determining the lower limit value for the excess of air is arranged in an exhaust-gas line (28) of the heat-supply device (21), and a third sensor (66) for determining the upper limit value for the excess of air is arranged on the heat-supply device, and wherein the second and third sensors are connected to the controller (63,64) for controlling the combustion-air supply to the burner (13'').

10. The plant according to claim 6, wherein heat exchangers (29,30,31) are arranged in an exhaust-gas duct (28) of the heat-supply device (21).

* * * * *